United States Patent [19]

Rinninger

[11] Patent Number: 4,572,699

[45] Date of Patent: Feb. 25, 1986

[54] PAVING STONE

[75] Inventor: Hans J. Rinninger, Kisslegg, Fed. Rep. of Germany

[73] Assignee: Hans Rinninger u. Sohn GmbH u. Co., Kisslegg, Fed. Rep. of Germany

[21] Appl. No.: 562,405

[22] Filed: Dec. 16, 1983

[30] Foreign Application Priority Data

Dec. 18, 1982 [DE] Fed. Rep. of Germany ... 8235649[U]
Jun. 20, 1983 [DE] Fed. Rep. of Germany ..... 3322090
Jul. 26, 1983 [DE] Fed. Rep. of Germany ..... 3326846

[51] Int. Cl.[4] ..... E01C 5/00

[52] U.S. Cl. ..... 404/42; 52/316; 52/608

[58] Field of Search ..... 404/34, 37–45, 404/29; 52/596, 604, 608, 316, 390

[56] References Cited

U.S. PATENT DOCUMENTS 929,366 7/1909 Alcott ..... 404/37
2,176,068 10/1939 Fischer ..... 404/44

FOREIGN PATENT DOCUMENTS 509161 2/1952 Belgium ..... 404/34
754165 2/1933 France ..... 404/34
7415523 1/1976 Netherlands ..... 404/42
8003927 2/1982 Netherlands ..... 404/39

*Primary Examiner*—James A. Leppink
*Assistant Examiner*—William P. Neuder
*Attorney, Agent, or Firm*—Michael J. Striker

[57] ABSTRACT

A paving stone, especially a concrete paving stone, serving for the paving of gardens and parks, paths, etc., is proposed. So that the paving stone laid out in a continuous system gives the best possible natural appearance, practical handling is guaranteed and strength is provided to an unrestricted degree, the side surfaces of the paving stone are designed as plane surfaces, but the transitional surfaces between the side surfaces and the upper surface are rounded and designed in such a way that the limiting line which is visible when seen from above is curved. The lateral limiting line between the transitional surface and the plane side surface is also shaped as a curved line, that is to say the corners are drawn down. For universal use, there are various construction sizes matching one another and special corner stones or curved stones which allow space-saving laying in a composite structure.

12 Claims, 13 Drawing Figures

A – A
B – B

PAVING STONE

BACKGROUND OF THE INVENTION

The invention relates to a paving stone, especially a concrete paving stone, for the paving of gardens and parks, paths or the like.

Paving stones are used for the paving of surfaces of any kind, such as roads, paths, gardens and parks, etc. Particularly for gardens and footpaths, a plurality of concrete paving stones with the most diverse shapes has become known. Known geometries for continuously laid concrete paving stones (pattern stone) are rectangular, square or honeycombed patterns. To achieve a three-dimensional spatial effect, the upper surface of the paving stone can have a geometry different from the remaining shape, for example a circular elevation on a honeycombed basic stone.

However, the disadvantage of known stones is that, when laid out, they have a more or less artificial, that is to say unnatural appearance because of the upper surface which is always plane. The plane upper surface of the paving stone is favorable for and chosen for reasons of production and transport.

Known paving stones are laid on a sand bed "touching" one another, that is to say in direct contact with one another. When the covering is subsequently vibrated down by means of a plate vibrator, the individual paving stones swivel into their final positions. At the same time, extremely high edge pressures frequently resulting in breakage of the stone corners arise.

Both rectangular and triangular stones which can be joined together as a set structure have become known in the literature. Wedge-shaped stones known in practice have basically the form of a trapezium when seen from above. When stones of this type are assembled, a honeycombed pattern which radiates outwards is obtained. With a trapezoidal base surface of wedge-shaped paving stones it is hardly possible to lay them in a continuous structure, that is to say offset relative to one another, since some large interspaces occur between the stones.

SUMMARY OF THE INVENTION

The object of the invention is to provide a paving stone which in a continuous structure gives the best possible natural appearance. At the same time, the stones will have such a geometrical shape that the typical damage to the paving stones during laying is avoided. The object of the invention is also to provide different stone shapes and sizes as a set structure. At the same time, among other things, a wedge-shaped stone will be given such a basic outline shape that it is possible to lay the paving stones in an extremely flexible and versatile manner, without interspaces occurring.

These objects are achieved by means of the features of the claims and particularly by means of the features of claim 1.

The invention starts from the knowledge that a natural appearance of a paving stone is obtained when the surface, that is to say the upper surface of the paving stone laid out in a continuous structure, appears as a convex surface, that is to say a curved surface. In conjunction with a specific coloring, a granite-like appearance of the artificially produced concrete paving stones is achieved, that is to say a natural rustic impression which is not artificial is given. The impression of a convex surface is produced artificially by not only rounding or chamfering the edges between the side surfaces and the plane or only slightly curved upper surface, but using a special transitional surface of different curvature between the plane side surfaces and the upper surface.

Because of its plane side surfaces, the paving stone has, as before, a basic square or rectangular shape, that is to say straight outer contours. The advantage of this is that making the mold, (plane surfaces) is cheaper, the best possible packaging capacity is provided, directional stability during laying in relation to stones with curved outer contours is improved, and better utilization of molds and surfaces is guaranteed.

The sub-claims relate to further measures for achieving the object according to the invention, particularly for the advantageous development and improvement of the paving stone according to the invention. The effect according to the invention is achieved, among other things, when the limiting line between the curved transitional surface and the upper plane surface of the paving stone is curved, and the line of curvature can be made circular, elliptical or even like a hyperbola, with a convex outer contour. Particularly in the case of a square stone, the simplest shape is to form the limiting line as segments of a circle, that is to say with circular radii. The width of the transitional surface between the plane side surfaces and the upper, preferably plane surface increases continuously from the center of the side surface towards the corners.

The limiting line between the transitional surface and the side surfaces can lie in one plane. Accordingly, in spite of its curvature, the transitional surface deviates only slightly from the plane upper surface, as a result of which the concrete mixture is compressed fairly uniformly and the stone has a homogeneous structure. To avoid the damage to the paving stones which is typical during laying and moreover to give the stones an even more pleasing appearance, according to the measures of subclaim 3 the corner regions of the transitional surface are drawn down. This results in greater compression and, correspondingly, a higher strength of these corner regions subjected to particularly high stress, so that breaks no longer occur. Another advantage of this stone form is that dirt, connecting the individual stones to one another and anchoring them more effectively in the ground, settles in course of time in the spandrels between individual paving stones after they have been laid. Finally, the drawndown corners intensify the natural effect of the curvature of the visible surfaces of the paving stones, and this gives the general impression of a curved upper surface.

It must also be considered an advantageous design that the paving stone is constructed according to the modular system, that is to say has different sizes which supplement one other in a most efficient way during laying. As a result, the most diverse patterns can be laid out, and a paving stone square when seen from above is used as a basic stone (standard stone) and is supplemented by a stone ($1\frac{1}{2}$-stone) enlarged by half the length of the "standard stone" and by a "$\frac{1}{2}$-stone" reduced by the same amount.

As an extension of the building-block system, the standard stone can also be made wedge-shaped in a way known per se, in order to allow the composite stones to be laid in an arc or a circle. An angle of 30° or 45° is appropriately used here, to obtain respective angles of 90°, 180° and 360°.

In an embodiment of the invention, the stones are designed as sectors of an annulus which form an annulus or portion of an annulus and several annuli or annulus portions are arranged concentrically relative to one another. As a result of this possible method of laying which is extremely flexible and versatile, the annuli or annulus portions can be displaced tangentially relative to one another to any extent desired. Thus, in an advantageous embodiment of the invention, the paving stones can be arranged in a continuous structure, that is to say offset relative to one another, or else in succession so as to radiate in a radial direction. It is appropriate, at the same time, if the wedge-shaped paving stones are formed at different angles, especially 30°, 45° or 60°. It is possible, furthermore, for annulus portions arranged radially in succession to form a kind of wavy line. The fact that the stones can be laid in many alternative arrangements without gaps is a particular advantage.

Exemplary embodiments of the invention are illustrated in the drawing and explained in more detail in the following description.

DETAILED DESCRIPTION OF THE PREFERRED EMBODIMENTS

Figures 1, 2, 3, 4, 5, 6:
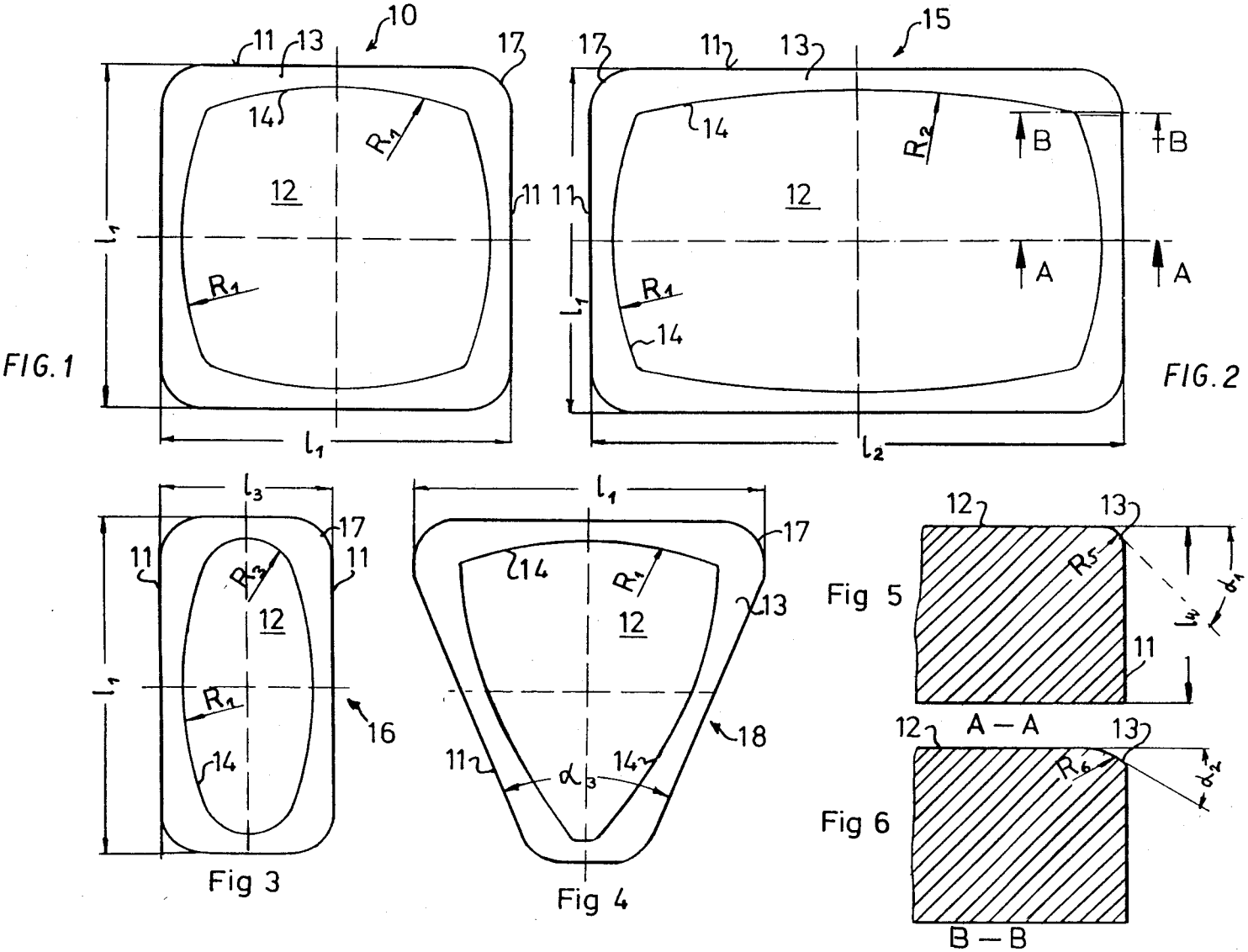
FIG. 1 shows a plan view of a square "standard stone"
FIG. 2 shows a plan view of the rectangular "1½-stone"
FIG. 3 shows a plan view of the rectangular "½-stone"
FIG. 4 shows a wedge-shaped "triangular stone"
FIGS. 5 and 6 show the sections A—A and B—B illustrated in FIG. 2.
Figure 10:
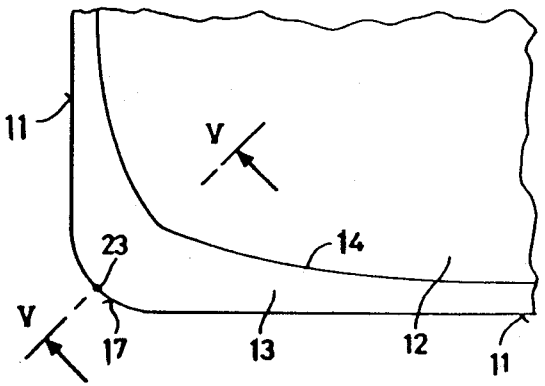
FIG. 10 shows the plan view in the corner region of the paving stone according to FIG. 7.
Figure 11:
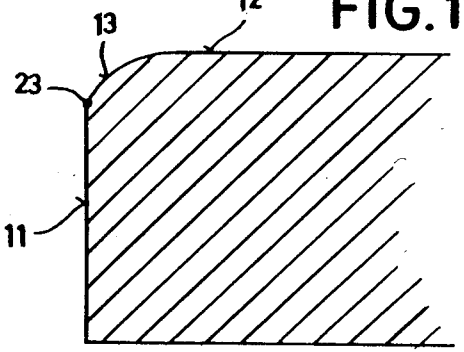
FIG. 11 shows a vertical section V—V according to FIG. 10, which corresponds to a corresponding 45° section through the other paving stones in the corner region.

The "standard stone" 10 shown in a plan view in FIG. 1 has a basic square cross-section. The side surfaces 11 of the paving stone according to the invention are designed as plane side surfaces, that is to say they are not curved. This is also true of the upper surface 12 of the paving stone which is likewise designed as a plane surface. The advantage of plane surfaces is that they are easier to produce by means of simpler molds and that the articles can be handled more efficiently during storage and use. However, the upper surface 12 can also have a slight curvature.

The transitional surface 13, designed according to the invention, between the plane side surface 11 and the plane upper surface 12 of the paving stone extends unevenly from one corner of the paving stone to the other. The transition between this transitional surface 13 and the upper plane surface 12 is formed by the limiting line 14. In the exemplary embodiment illustrated, this limiting line has the form of a sector of a circle. However, it can also have the form of an ellipse or hyperbola.

As a result of this circular design of the limiting line 14 in conjunction with the plane side surfaces 11, the transitional surface 13 is enlarged towards the corners of the paving stone. At the same time, the tangent angle $\alpha$ changes constantly, as shown in cross-section in FIGS. 5 and 6. With a normal rounded edge (section A—A) would be constant at 45°. In the paving stone according to the invention, this angle diminishes constantly towards the corner, since the rounding of the transitional surface 13 increases towards the corner (see $\alpha_2$ in FIG. 6). Accordingly, the radius R5 of the transitional surface 13, shown in FIG. 5, amounts, for example, to 7.4 mm, and the radius $R_6$ shown in FIG. 6 amounts to 22 mm.

The "1½-stone" 15 shown in FIG. 2 is lengthened by half the amount of the "standard stone" 10. Consequently, the square standard stone 10 has, for example, a side length of $l_1 = 12$ cm, and the rectangular 1½-stone 15 likewise has the same width, but a length of $l_2 = 18$ cm. The "½-stone" 16 illustrated in FIG. 3 corresponds in its dimensions to half the size of the standard stone 10. With the same side length $l_1$ as the standard stone 10, the ½-stone 16 has a width of $l_3 = 6$ cm.

The transition between the side surfaces 11 is formed by the rounded surfaces 17 with a radius of, for example, 15 mm.

The above-described dimensions of the paving stones 10, 15, 16 serve for incorporating the paving stones in a modular system with a 6-cm grid, that is to say areas of 6 cm and a multiple of this can be laid out.

In these dimensions, $R_1 = 125$ mm is used as a radius for the curved limiting line in FIG. 1. This corresponds to the radius of the limiting line on the short side of FIG. 2. The radius $R_2$ of the limiting line 14 on the long side of the 1½-stone 15 is $R_2 = 346$ mm. The limiting line 14 in the paving stone according to FIG. 3 likewise has the radius $R_1 = 125$ mm and a radius $R_3$ of approximately 16 mm.

FIG. 4 illustrates a wedge-shaped triangular stone 18 which serves for laying arcuate or circular patterns. This stone has basically the same construction as the standard stone according to FIG. 1. The angle $\alpha$ formed by the side surface 11 will appropriately amount to 30, 45 or $60_o$, in order to obtain the dimension 90°, 180° or 360°. In this stone, the curved limiting line 14 is likewise a circular line corresponding to the exemplary embodiment according to FIG. 1.

The sections taken from FIG. 2 and illustrated in FIGS. 5 and 6 show, in particular, the formation of the changing curvature of the transition surface 13. The height $l_4$ of the paving stone varies according to strength requirements. It can amount in particular to $l_4 = 6$ cm.

Figure 7:
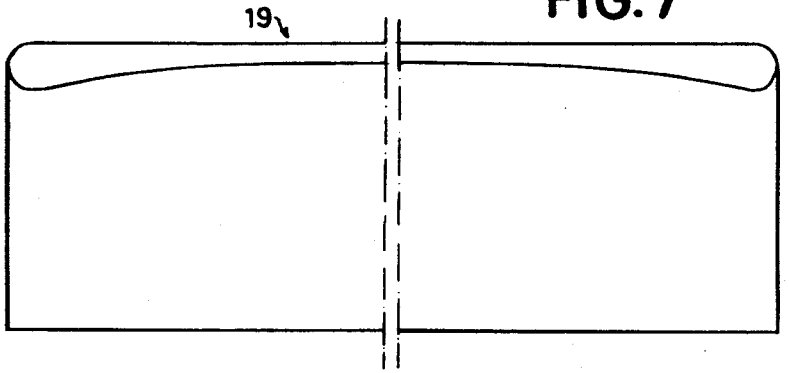
FIG. 7 shows a side view of a paving stone with a drawn-down corner, having the dimensions 12×18 cm.
Figure 8:
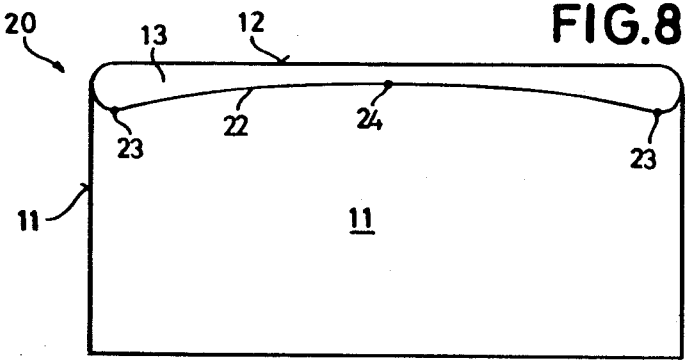
FIG. 8 shows the end view of the paving stone according to FIG. 7, or the side view of a square paving stone of 12×12 cm.
Figure 9:
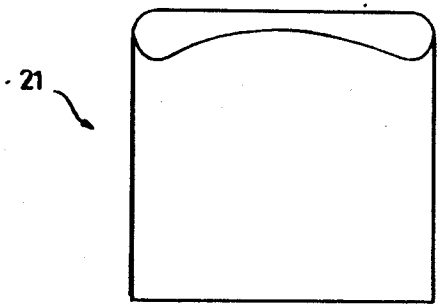
FIG. 9 shows the end view of a paving stone of 6×12 cm.

A further exemplary embodiment of the invention according to the illustration in FIGS. 7 to 11 shows a paving stone of which the corner regions of the transitional surfaces are drawn down. The paving stones according to FIGS. 7 to 9 are denoted by 19 to 21. Otherwise, the reference numerals in FIGS. 1 to 3 are used insofar as they relate to the same object.

The upper surface 12 which is plane in the example merges at the limiting line 14 into the curved transitional surface 13. Since this transition takes place gradually (asymptotically) and the visible surface 12, 13 as a whole is formed by means of a die plate, the limiting line 14 is in reality scarcely visible. This impression is reinforced insofar as the upper surface 12 is likewise curved slightly.

In contrast to this, a distinct limiting line 22 can be seen between the transitional surface 13 and the side surfaces 11 or the curved edge regions 17. In the center of the curved edge regions 17, this limiting line reaches its lowest points 23 and in the center of the side surfaces its highest points 24, and these points are each points of contact with imaginary horizontal tangents.

Figures 12A, 12B:
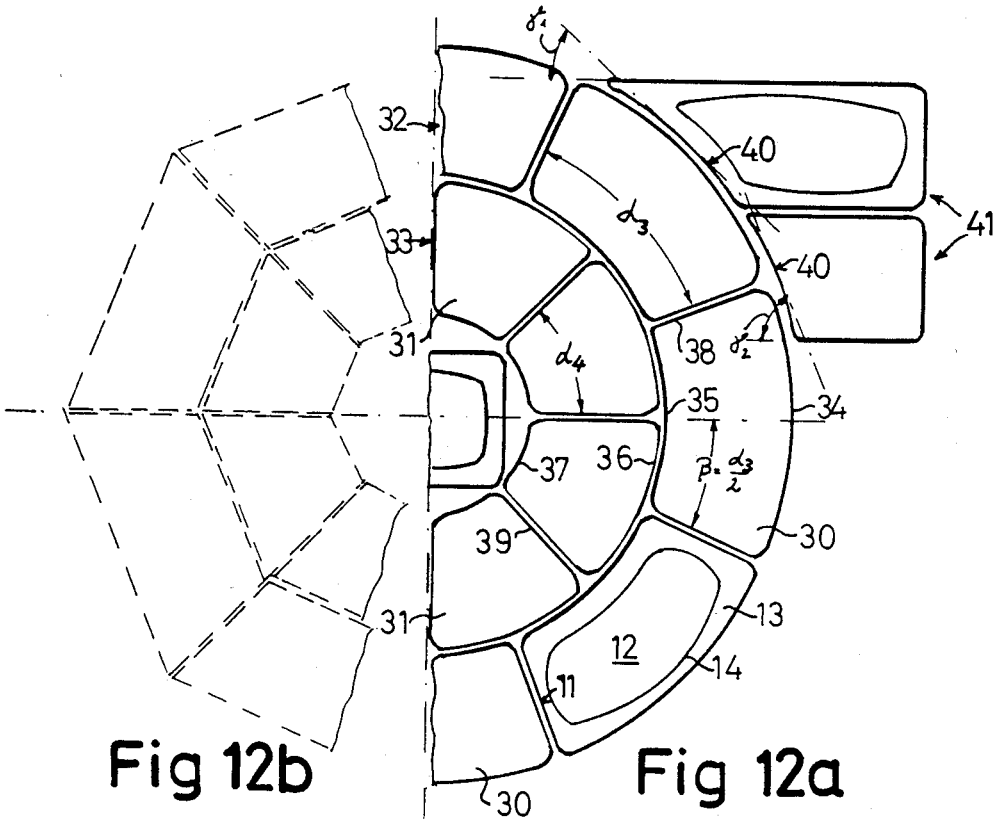
FIG. 12*a* shows an exemplary embodiment with an angular stone of 45° with connecting stones.
FIG. 12*b* shows a known wedge-shaped stone of trapezoidal shape.

In the exemplary embodiment according to FIGS. 12*a* and 12*b*, a development of the invention as a curved stone is illustrated. In the drawing shown in FIG. 12*a*, the paving stones 30, 31 according to the invention are designed as sectors of an annulus which, depending on the diameter of the annuli, form annuli 32, 33 arranged concentrically relative to one another. The angles $\alpha_3$ and $\alpha_4$ which are formed each amount to 45° in the exemplary embodiment.

A determining feature of the paving stones according to the invention is the limiting lines 34 to 37 which are arcuate as seen in a radial direction and which are each located on a circle. The annuli according to the invention are formed as a result. The lateral limiting surfaces 38, 39 of the annulus sectors 30, 31 have the same dimensions. To that extent, the sectors of the annuli 32, 33 arranged concentrically relative to one another increase in size the further outwards radially they are laid. At the same time, however, the sectors of the particular annulus next but one can be composed of two sectors of the annulus last but one. Also, of course, other angular combinations, that is to say annulus sectors with different angles such as, for example, 30° or 60° can be used.

The advantage of the paving stone according to the invention is that the annuli 32, 33 can be offset relative to one another continuously in a tangential direction, without any edges or corners standing in the way. As a result, this design differs fundamentally from the known mounting illustrated in FIG. 12*b*. Thus, according to the illustration in FIG. 12*a*, it is possible to lay the paving stones in a continuous structure, that is to say the outer annulus sectors 30 overlap the inner annulus sectors 31, thus producing a pleasing appearance. In a completely symmetrical method of laying, the overlapping of the outer annulus sectors 30 can be, for example, $\beta=\alpha_1/2$.

Of course, the various annuli can also be arranged so as to radiate outwards, but this gives a general impression as shown in FIG. 12*b*. Because the outer contours follow the arc of a circle, there are also few interspaces between the individual paving stones, especially when they are laid in a continuous structure. As a result, the danger of an accident during walking (for example, caused by high-heeled shoes) is greatly reduced.

The combination of different stones with different angles increases the many possible variations to an unlimited extent, although extremely precise laying is nevertheless guaranteed. Moreover, the outer shaping of the stones always corresponds to the invention illustrated in FIGS. 1 to 11. This is indicated in FIG. 12*a* by the reference numerals 12 to 14.

In a development of the invention, a transition between laying in a curve or an arc and normal parallel laying of the paving stones is provided. For this purpose, the stone 41 must be bevelled along a straight line or else concavely at a specific angle $\alpha$ on one of its end faces 40. Depending on the matching with the curvature of the annulus portion 32, connecting stones with various angles $\gamma_1$, $\gamma_2$ can be provided.

The paving stone according to the invention can be used universally in all its variations for laying out the most diverse laying patterns, the design according to the invention producing a particularly natural granite-like effect in a continuous structure.

I claim:

1. A paving stone, especially a concrete paving stone, for the paving of gardens and parks, paths or the like, wherein all side surfaces (11) of the paving stone (10, 15, 16, 18 to 21, 30, 31) are designed as plane surfaces, and wherein the transitional surface (13) between the side surfaces (11) and an upper surface (12) of the paving stone is rounded, the paving stone further including edge regions (17) between the side surfaces which are strongly drawn so that a limiting line (14) between the transitional surface (13) and the upper surface (12) is curved when seen from above, said edge regions being rounded as seen from above.

2. A paving stone as claimed in claim 1, wherein the upper surface (12) of the paving stone, when seen from above, has convex outer contours, the limiting line (14) between the curved transitional surface (13) and the preferably plane upper surface (12) being circular, elliptical or hyperbolic, and the width of the transitional surface (13) between the side surfaces (11) and the upper surface (12) increasing continuously from the center of the side surface towards the corner.

3. A paving stone as claimed in claim 1, wherein the limiting line (22) between the transitional surface (13) and the side surfaces (11) and edge regions (17) is curved in such a way that it alternates smoothly between lowest points (23) in the center of the edge regions (17) and highest points (24) in the center of the side surfaces (11).

4. A paving stone as claimed in claim 1, wherein the paving stones are constructed according to the modular system, with a "standard stone" (10) square when seen from above, "1½-stone" enlarged by half the length of the standard stone and rectangular when seen from above, and a "½-stone" corresponding in its width to half the length of the standard stone.

5. A paving stone as claimed in claim 1, the outer dimension of which is designed according to a 6-cm grid and in particular amounts to 6, 12 and 18 cm.

6. A paving stone as claimed in claim 1, which is designed as a wedge-shaped triangular stone (18, 30, 31), especially with an angle formed by the two side surfaces of 30°, 45° or 60°.

7. A paving stone as claimed in claim 1, wherein the stones are designed as sectors (30, 31) of an annulus which form an annulus (32, 33) or portions of an annulus, and wherein several annuli or annulus portions (32, 33) formed from annulus sectors are arranged concentrically relative to one another, and the side surfaces (38, 39) which are arranged in a radial direction and touch one another and which belong to two paving stones adjacent to one another in the annulus, are designed as plane surfaces.

8. A paving stone as claimed in claim 7, wherein the annulus sectors (30, 31) located radially in succession are arranged so as to be offset tangentially relative to one another and/or so as to radiate in succession.

9. A paving stone as claimed in claim 8, wherein a rectangular or square paving stone (41), functioning as a transition stone or connectin stone (41) between paving stones laid in the form of an annulus or portions of an annulus and paving stones laid parallel in a continuous structure, is bevelled at least on one lateral end face (40) in such a way that the stone matches the outer annular surface (34) without interspaces.

10. A paving stone, especially a concrete paving stone, for the paving of gardens and parks, paths or the like, wherein the side surfaces (11) of the paving stone (10, 15 16, 18 to 21, 30, 31) are designed as plane surfaces, and wherein a transitional surface (13) between the side surfaces (11) and an upper surface (12) of the paving stone is rounded and designed in such a way that a limiting line (14) between the transitional surface (13) and the upper surface (12) is curved when seen from above, wherein the stones are designed as annulas sectors (30, 31) which form an annulus (32, 33) or portions of an annulus, and wherein several annuli or annulus portions (32, 33) formed from annulus sectors are arranged concentrically relative to one another, and the side surfaces (38, 39) which are arranged in a radial direction and touch one another and which belong to two paving stones adjacent to one another in the annulus, are designed as plane surfaces.

11. A paving stone as claimed in claim 10, wherein the annulus sectors (30, 31) located radially in succession are arranged so as to be offset tangentially relative to one another and/or so as to radiate in succession.

12. A paving stone as claimed in claim 10, wherein a rectangular or square paving stone (41), functioning as a transition stone or connecting stone (41) between paving stones laid in the form of an annulus or portions of an annulus and paving stones laid parallel in a continuous structure, is bevelled at least on one lateral end face (40) in such a way that the stone matches the outer annular surface (34) without interspaces.

* * * * *